US007765903B2

(12) United States Patent
Schorcht et al.

(10) Patent No.: US 7,765,903 B2
(45) Date of Patent: Aug. 3, 2010

(54) METHOD AND DEVICE FOR PROCESSING OPTICAL WORKPIECE SURFACES

(75) Inventors: Ralf Schorcht, Koenigsbronn (DE); Georg Michels, Aalen (DE)

(73) Assignee: Carl Zeiss SMT AG, Oberkochen (DE)

( * ) Notice: Subject to any disclaimer, the term of this patent is extended or adjusted under 35 U.S.C. 154(b) by 853 days.

(21) Appl. No.: 11/658,426

(22) PCT Filed: Aug. 2, 2005

(86) PCT No.: PCT/EP2005/008329

§ 371 (c)(1),
(2), (4) Date: Jan. 26, 2007

(87) PCT Pub. No.: WO2006/015761

PCT Pub. Date: Feb. 16, 2006

(65) Prior Publication Data

US 2007/0247589 A1 Oct. 25, 2007

(30) Foreign Application Priority Data

Aug. 2, 2004 (DE) ..... 10 004 037 454

(51) Int. Cl.
*B24B 13/00* (2006.01)
*B24B 1/00* (2006.01)

(52) U.S. Cl. ..... 82/1.11; 82/117

(58) Field of Classification Search ..... 82/1.11, 82/1.5, 117, 118, 133, 137; 29/27 C, 28; 451/42

See application file for complete search history.

(56) References Cited

U.S. PATENT DOCUMENTS

| | | | | |
|---|---|---|---|---|
| 4,680,998 | A * | 7/1987 | Council, Jr. | 82/1.11 |
| 4,862,646 | A | 9/1989 | Briones | |
| 6,478,658 | B1 | 11/2002 | Logan | |
| 6,523,443 | B1 * | 2/2003 | Hof et al. | 82/1.4 |
| 7,597,033 | B2 * | 10/2009 | Savoie et al. | 82/1.11 |
| 2007/0180961 | A1 * | 8/2007 | Imai et al. | 82/1.5 |

FOREIGN PATENT DOCUMENTS

| | | |
|---|---|---|
| DE | 1072502 | 6/1955 |
| DE | 19616526 | 11/1997 |
| DE | 19860101 | 7/1999 |
| DE | 10248103 | 5/2003 |
| GB | 563067 | 7/1944 |
| JP | 4025366 A | 1/1992 |

* cited by examiner

*Primary Examiner*—Will Fridie, Jr.
(74) *Attorney, Agent, or Firm*—Wells St. John P.S.

(57) ABSTRACT

The invention relates to a method for processing the surfaces of optical workpieces (3) such as optical or eye glass lenses carried out with the aid of a tool (5) and consisting in holding at least one workpiece (3) in a work piece receiving support (4) which is rotatable around the axis of a workpiece spindle (1'). The invention is characterized in that the workpiece (3) is received in the receiving support (4) in such a way that the axis of rotation (2) of the workpiece spindle is placed remotely from the axis (8) of at least one workpiece (3) and the axis (18) of the workpiece support is at least partially in a parallel position to the axis of rotation of the workpiece spindle.

35 Claims, 2 Drawing Sheets

METHOD AND DEVICE FOR PROCESSING OPTICAL WORKPIECE SURFACES

CROSS REFERENCE TO RELATED APPLICATION

This is a 35 U.S.C. §371 application of and claims priority to PCT International Application No. PCT/EP2005/008329, which was filed Aug. 2, 2005, and which claims priority to German Patent Application No. 10 2004 037 454.6, which was filed Aug. 2, 2004, and the teachings of all the applications are incorporated herein by reference.

The invention relates to a method for processing surfaces of optical workpieces, such as lenses or spectacle glasses, by means of a tool, at least one optical workpiece being held in a workpiece fixture rotating about an axis of a workpiece spindle. The invention also relates, further, to a processing device for workpiece surfaces.

In the methods known hitherto for processing surfaces of optical workpieces, in particular for processing spectacle glasses, the workpiece is chucked in a workpiece fixture located on a workpiece spindle. A workpiece axis of the workpiece coincides with an axis of rotation of the workpiece spindle. During processing, the workpiece surface acquires an exactly defined surface shape by premachining with a normally diamond-impregnated grinding, milling or turning tool. The surface is reworked once again with a finer tool. By subsequently being polished, the surface acquires the desired surface quality.

This type of production of spectacle glasses is known, for example, from DE 196 16 526 A1 and from DE 102 48 103 A1.

One disadvantage, however, is that, in a turning process with a constant rotational speed, the cutting speed approaches zero toward the axis of rotation of the workpiece spindle, with the result that the chip formation and chip flow conditions vary continuously, until, at the center of the workpiece, the actual cutting process is superseded by material displacement.

The formation of the surface or the surface quality is consequently only inadequate. In order to achieve a uniform processing result on the entire surface of the workpiece, the cutting speed would have to be kept constant. This means, however, that a continuous processing rotational speed approaching infinity would have to be achieved toward the center of rotation, although, in practice, this cannot be implemented due to limited spindle rotational speeds, workpiece chucking systems, etc. In order to process the workpiece surface accurately and cleanly, furthermore, an exact adjustment of the tools is a precondition. The adjustment of the tools must therefore be carried out at regular intervals, for example because of thermally induced machine drift or tool wear, thus leading to an interruption in the manufacturing sequence.

EP 1 175 962 A1 describes a processing device for the processing of lens blanks with the axes of the lens blanks and of their fixtures being arranged perpendicularly to a workpiece spindle axis. For the further prior art, reference is also made to DE 198 60 101 A1 and to Patent Abstracts of Japan 04025366 AA.

The object of the invention is to provide a method for processing optical workpieces, such as optical lenses or spectacle glasses, by means of which a high surface quality over the entire area of the workpiece can be achieved without additional processing steps, while, if required, even a plurality of optical workpieces can be processed simultaneously or in succession without overly high outlay.

The object is achieved, according to the invention, in that the workpiece is received by the workpiece fixture in such a way that the axis of rotation of the workpiece spindle runs at a distance from a workpiece axis of the at least one workpiece, an axis of the workpiece fixture lying at least approximately parallel to the axis of rotation of the workpiece spindle.

According to the invention, the workpiece axis of the workpiece and consequently also that of the workpiece fixture do not coincide with the axis of rotation of the workpiece spindle. By the axis of rotation of the workpiece spindle being shifted out of the center of the workpiece, for example into an edge region of the workpiece which is worked off in a later workpiece machining process or is irrelevant for the final product, the center problem or the singularity of the previous rotational movement, to be precise the fact that the actual cutting process is superseded by material displacement and therefore surface formation is inadequate, is shifted, for example, into the edge region of the workpiece. The problem, described in the prior art, of exact tool adjustment to be repeated at regular intervals, to be precise the fact that a cutting edge of the tool intersects the axis of rotation of the workpiece spindle, is likewise solved by the axis of rotation of the workpiece spindle being shifted to a distance from the workpiece axis of the workpiece or by the axis of rotation being shifted into an irrelevant edge region of the workpiece. An exact adjustment of the tool is thereby no longer necessary, thus achieving an acceleration of the manufacturing sequence. Likewise, in this way, since high-precision surface quality is obtained at the center of the workpieces, subsequent processing steps, such as polishing, may, if appropriate, be dispensed with.

In an advantageous embodiment of the invention, there may be provision for the axis of rotation of the workpiece spindle to run outside the at least one workpiece, with the result that a cutting speed of 0 is avoided and the center problem is thereby eliminated completely. A further advantage is that a plurality of workpieces can be processed simultaneously on the workpiece spindle. Such a parallel processing of the workpieces leads to an increase in efficiency, lower costs and a time saving.

The axis of the workpiece fixture may be identical to the workpiece axis, but this is basically not absolutely necessary.

Claim 25 specifies a processing device according to the invention, by means of which the method according to the invention can be carried out.

Advantageous refinements and developments of the invention may be gathered from the remaining subclaims. Exemplary embodiments of the invention are explained in more detail below by means of the drawing in which:

Figure 1:
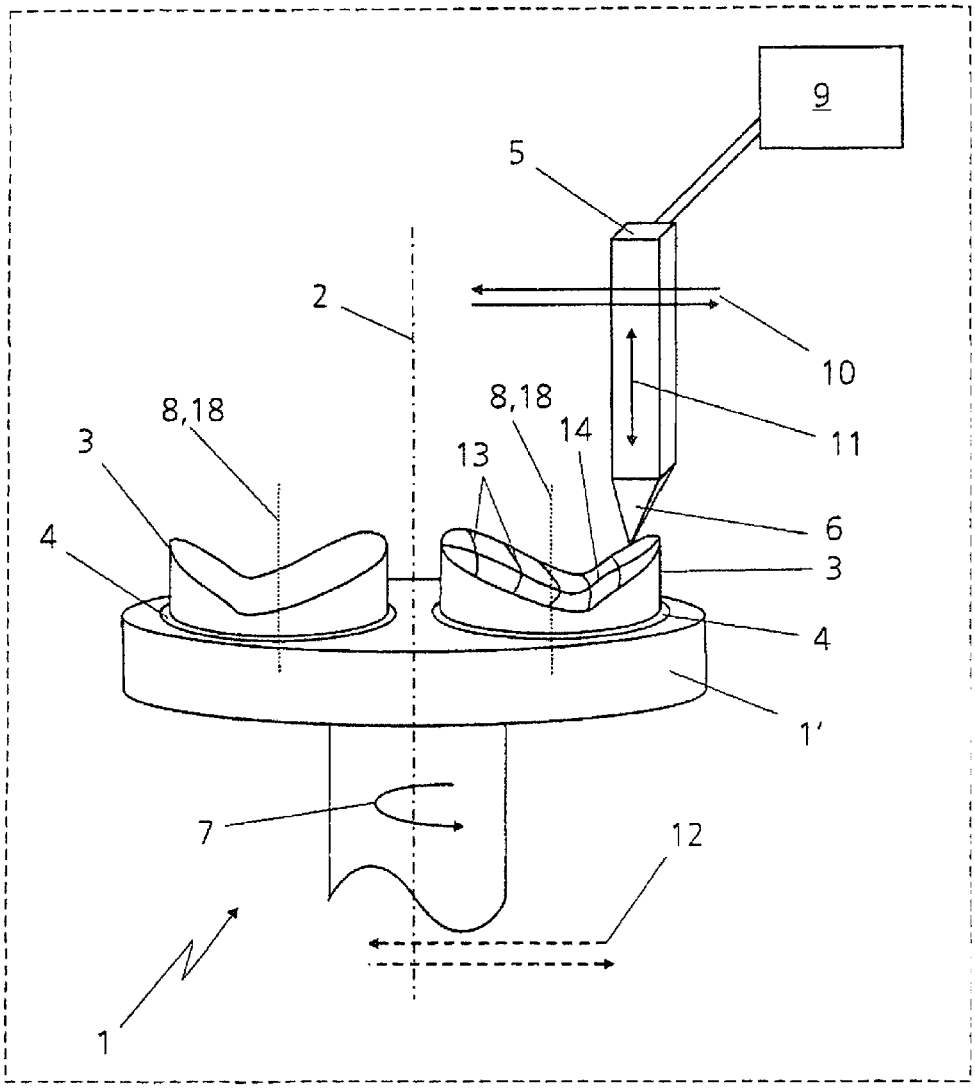
FIG. 1 shows a basic illustration of an arrangement according to the invention of workpieces on a workpiece spindle in conjunction with a tool.

FIG. 1 illustrates a processing device 1, shown only by dashes, in the present case a lathe, with a workpiece spindle 1' which has an axis of rotation 2. The workpiece spindle 1' has mounted on it, in this exemplary embodiment, two workpieces 3 which are held in each case in a workpiece fixture 4, illustrated only highly diagrammatically. The workpieces 3 may be in the form of optical workpieces, such as, for example, optical lenses or spectacle glasses. In this, as in the following exemplary embodiments, the workpieces 3 are assumed to be blanks of spectacle glasses. To process the workpieces 3 with a tool 5 which has a cutting edge 6, the workpiece spindle 1' rotates about its axis of rotation 2 according to the arrow 7. To produce spectacle glasses as workpieces 3 the tool 5 used is normally a diamond tool. To produce organic spectacle glasses, advantageously polycrystalline diamond tools are used for premachining and monocrystalline diamond tools for precision machining. Of course, even only one workpiece 3 may be mounted on the workpiece spindle 1' for processing.

As is evident from FIG. 1, the axis of rotation 2 of the workpiece spindle 1' runs, during this turning machining, outside the spectacle glasses to be manufactured, owing to the special workpiece arrangement. The workpiece axes 8 of the workpieces 3 which correspond to the axes of the workpiece fixtures 4 run parallel to the axis of rotation 2 of the workpiece spindle 1', but they do not coincide with the axis of rotation 2 of the workpiece spindle 1'. If appropriate, even a slight deviation from parallelism between the workpiece axis 8 and axis of rotation may be advantageous, as explained in more detail below with reference to FIG. 3 with the axis 8. The same applies to longitudinal axes 18 of the workpiece fixtures 4. Thus, a plurality of workpieces 3 can be arranged on the workpiece spindle 1', with the result that a parallel processing of the workpieces 3 can take place. In the exemplary embodiment illustrated, the workpiece axes 8 also correspond to the axes 18 of the workpiece fixtures 4, although this does not necessarily have to be the case. As is clear, the workpieces 3 are mounted on the workpiece spindle 1' in one plane. In the processing of surfaces of the workpieces 3 according to the prior art, only one workpiece is arranged on the workpiece spindle 1', the workpiece axis 8 coinciding with the axis of rotation 2 of the workpiece spindle 1'.

An alternative possibility for arranging a workpiece 3 on the workpiece spindle 1' is that the axis of rotation 2 of the workpiece spindle 1', although running through the workpiece 3, does not coincide with the workpiece axis 8 of the latter. As a result, the problem to be solved of material displacement from the center of the workpiece 3 is merely shifted to the corresponding intersection point of the workpiece 3 with the axis of rotation 2 of the workpiece spindle 1', so that even that region in which the cutting speed becomes zero lies in the region of the workpiece surface to be manufactured. This problem can be avoided, however, if the axis of rotation 2 of the workpiece spindle 1' runs through the workpiece 3, but in a region which is worked off or removed later due to the fitting of the spectacle glass into a rim. The material displacement is thereby shifted into an edge region of the workpiece 3 which is irrelevant for the final product. In order to process the workpiece 3 in this way, what should be known before the turning machining is the shape of the rim into which the spectacle glass is to be fitted later, so that the material displacement in the workpiece 3 can be shifted into the region which is removed when the spectacle glass is fitted into the rim. A sufficient surface quality can thus likewise be achieved, but a parallel processing of a plurality of workpieces 3 on the workpiece spindle 1' cannot be implemented here.

To process the workpieces 3, the tool 5 is held in a highly dynamic tool feed unit (Fast Tool Servo-system=FTS system or Slow Tool Servo-system) 9. Axial tool feed in this case takes place via the highly dynamic tool feed unit 9. This highly dynamic tool feed unit 9 can be controlled and/or regulated simultaneously with other machine axes and makes it possible to produce non-rotationally symmetrical components on lathes. Conventionally, these are designed as piezoelectric drives or drives driven by Lorenz force; however, any other way of implementing the feed movement may also be envisaged. In this case, during processing, the angle and position of the tool 5, in the turning machining involved here by means of a lathe chisel, are detected, and the necessary feed is calculated online. The highly dynamic drive varies the feed of the tool 5 according to the desired contour. In this way, with the aid of suitable tools 5, rotationally symmetrical and also non-rotationally symmetrical surfaces (free form surfaces) can be produced effectively and efficiently. Since the processing is a continuous cutting movement, better surface qualities than in a milling process with an interrupted cut can be achieved.

In order to achieve optimal results, a tool feed unit with a stroke frequency of >15000 Hz, preferably of >20000 Hz, with a stroke of up to 35 mm is used. A surface roughness RMS of <20 nm, even of between 2 and 10 nm, can thereby be achieved.

In the processing of nonplanar surfaces not perpendicular to the axis of rotation 2 of the workpiece spindle 1', as here, it is necessary for the axis of rotation 2 to be coupled to the feed movement of the tool 5. This is implemented via the tool feed unit 9. The tool feed unit 9 makes it possible during a spindle revolution to have defined changes of the feed as a function of the angular position of the workpiece spindle 1'. In this case, however, it must be remembered that, with an increasing spindle rotational speed, very high acceleration values or stroke frequencies, along with high precision of movement at the same time, must be achieved.

A continuous radial advance of the tool 5 is illustrated in FIG. 1 by the arrows 10. Dynamic tool feed takes place synchronously with the workpiece spindle 1' by means of the tool feed unit 9 and is illustrated by the arrow 11. An alternative implementation of the radial advance may also be effected by a movement of the workpiece spindle 1' along the arrows 12. Thus, depending on the machine design, apportioning the required radial and axial feed to the tool 5 and the workpiece 3 can afford advantages in terms of machine accuracy, machine dynamics, vibration damping, etc. For example, the axial feed may take place by the tool 5 and the radial feed by the workpiece spindle 1'.

The turning machining of the workpieces 3 by means of the tool 5 will be described only briefly here, since it is already generally known from the prior art. The processing of the surfaces of the workpieces 3 by means of the tool 5, the workpieces 3 rotating about the axis of rotation 2 of the workpiece spindle 1', takes place radially slowly from the outer region of the workpiece spindle 1' in the direction of the axis of rotation 2. The tool 5 in this case executes relatively short rapid axial up and down movements and thereby gradually introduces the desired contour into the workpieces 3. For each revolution of the workpiece spindle 1' about its axis of rotation 2, the tool 5 executes a plurality of stroke movements parallel to the axis of rotation 2 by means of the tool feed unit 9, thus ensuring a feed of the tool 5 at very high frequency. A plurality of workpieces 3 can be processed simultaneously on the workpiece spindle 1' by means of the tool 5, with the result that the regions of the surfaces of the workpieces 3 are provided with the contour predetermined by the processing device 1. The processing of the surfaces of the workpieces 3 may, of course, also take place from the axis of rotation 2 in the direction of the edge of the workpiece spindle 1'.

In order, however, while having the same required overall stroke travel of the tool 5, to reduce the fraction of the stroke travel to be covered highly dynamically in the production of non-rotationally symmetrical workpieces 3 or of workpieces 3 with different surface curvatures, it is advantageous to chuck the workpiece 3 such that the path curve segments to be covered by the tool 5 for chip removal, which place the lower demands on the feed movements, which means surface curvatures of larger radius, run tangentially with respect to the cutting direction of the tool. Such advantageous path curve segments are given the reference symbol 13 in FIG. 1 and, for simplification, are illustrated in only one workpiece 3 by lines. What is meant by a path curve is the movement travel of the tool 5 which the tool 5 covers during its multiple spiral 360° C. rotation for processing, in a comparable way to a record. The direction of advance 10 of the tool thus runs perpendicularly with respect to the rotation of the tool 5 or radially, for example from the outside inward.

Surface curve segments of the workpieces which place very high demands on the feed movement in terms of the travel to be covered and stroke dynamics, which means surface curvatures of smaller radius, are to be oriented by a corresponding alignment of the workpiece 3 such that these (given the reference symbol 14 in FIG. 1) run radially in the direction of advance 10 of the tool 5. In such an arrangement of the workpiece 3, for each revolution, the tool 5, when moving over the path curve segments 13, has to cover highly dynamically markedly less feed travel than would be the case in an arrangement, rotated through 90° about the workpiece axis 8, of the workpiece 3 and a travel over surface curve segments along or parallel to the line 20, 14.

The above-described feed movements of the tool 5 are an optimization in terms of accuracy and time, since the unavoidable stroke movements are thereby kept as low as possible. This feed method can be applied to all shapes of surfaces, such as free form surfaces, symmetrical, asymmetric and aspherical surfaces of the workpieces 3.

Figure 3:
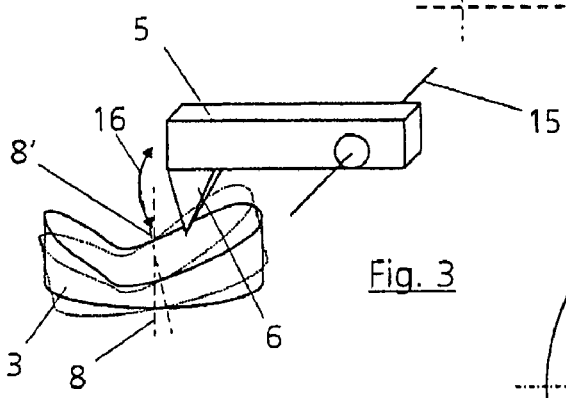
FIG. 3 shows a basic illustration of an alternative tool feed via a rotational movement.

If a region of that surface of the surface curve segment of a workpiece 3 which is to be processed has a very high gradient, the workpiece to be processed may also be chucked in the tool fixture 4 such that the workpiece axis 8 is tilted at a corresponding angle to the axis of rotation 2 of the workpiece spindle 11, as may be gathered from FIG. 3 with the reference symbol "8'" and the dashed illustration. In such an oblique position of the workpiece axis 8', lower stroke movements are required from the tool. If appropriate, the axis 18 of the workpiece fixture 4 itself may also be set obliquely together with the workpiece axis 8'. The oblique position and consequently the deviation from parallelism may amount, for example, to 5-10°.

Figure 2:
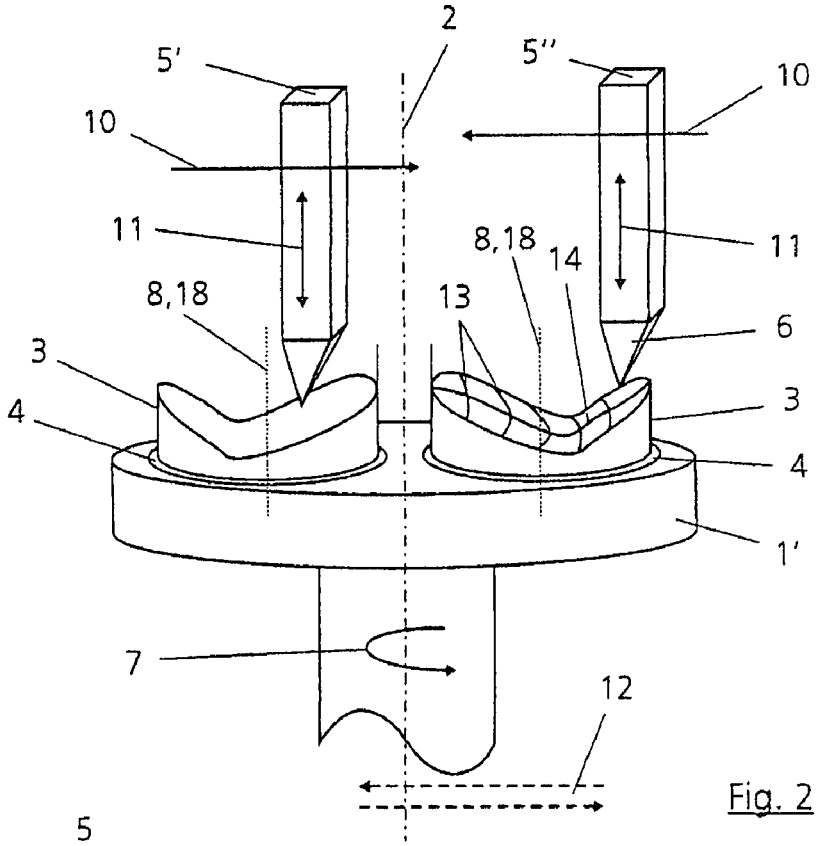
FIG. 2 shows a basic illustration of the workpiece spindle with workpieces when two tools are used for processing the workpieces.

FIG. 2 shows the processing of the workpieces 3 by tools 5' and 5" which, in this exemplary embodiment, constitute two different tools. Since the arrangement of the workpieces 3 on the workpiece spindle 1' corresponds basically to the exemplary embodiment according to FIG. 1, the same reference symbols have also been used for identical parts. As is evident in FIG. 2, the use of a plurality of tools 5' and 5" is possible, in order thereby appreciably to shorten the processing time of the workpieces 3. For the simultaneous processing of the workpieces 3, identical tools 5 may be used or else, as illustrated in FIG. 2, different tools 5' and 5" for a preliminary and a precision turning process. In this exemplary embodiment, the tool 5' is designed as a preliminary turning tool and the tool 5" as a precision turning tool.

Here, too, the tool feed again takes place synchronously to the workpiece spindle 1' by means of the tool feed unit 9. The radial advance of the tools 5' and 5" likewise takes place in each case from the outer region of the workpiece spindle 1' toward its axis of rotation 2. Here, too, of course, the radial advance may take place outward from the axis of rotation 2 in the opposite direction to the direction of the arrow 10. The alternative implementation of the radial advance by the workpiece spindle 1' being moved back and forth according to the arrows 12 is also possible here, but then, contrary to the illustration in FIG. 2, the tools 5' and 5" must be arranged sequentially in the direction of advance on one side of the workpiece spindle 1'.

Furthermore, as illustrated in FIGS. 1 and 2, the feed of the tools 5, 5' and 5" may be implemented not linearly, but, instead, via a rotational movement or pivoting movements as illustrated by way of example in FIG. 3. In this case, the tool 5 and therefore the tool cutting edge 6 oscillate about an axis of rotation 15, only a slight movement of the tool 5 upward and downward according to the arrow 16 taking place. Such a configuration of the tool 5 or such a processing of the workpieces 3 by the tool 5 from FIG. 3 is advantageous to the effect that the axis of rotation 15 can be manufactured more simply and more accurately than an axial feed or a linear guide.

Figure 4:
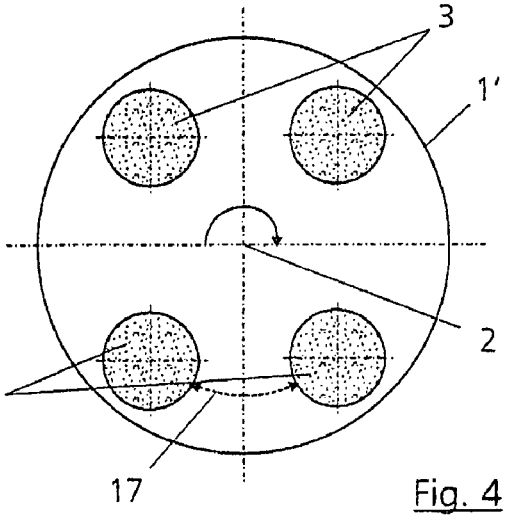
FIG. 4 shows a basic illustration of the workpiece spindle with workpieces in a top view.

FIG. 4 illustrates a top view of the workpiece spindle 1' with the workpieces 3 located on it. In this exemplary embodiment, four workpieces 3 are arranged on the workpiece spindle 1'. The workpieces 3 may be provided with identical optical surfaces, although different optical surfaces, such as, for example, spherical surfaces, toroidal surfaces, symmetrical aspherical surfaces or else asymmetric aspherical surfaces, may also be generated simultaneously in the workpieces 3 by means of the tool 5 or by means of the tools 5' and 5". Thus, rotationally symmetrical and non-rotationally symmetrical workpieces 3 can thereby be generated simultaneously on the workpiece spindle 1'. Even workpieces consisting of different materials can likewise be processed simultaneously, insofar as the same processing parameters, such as cutting speed, advance, etc., that is to say similarities in the chipping process behavior, are present.

Depending on the complexity of the workpiece geometries to be manufactured, an interspace 17 or the movement travel of the tool 5 or 5' and 5" is to be interpolated between the individual workpieces 3 with suitable travel parameters. The respective interspace 17 for interpolation between the individual workpieces 3 is required so that a continuous smoothed tool path can be calculated and therefore theoretically possible jumps in the feed of the tool 5, 5', 5" from exit from one workpiece 3 to entry into another workpiece 3 can be ruled out. This means that the corresponding surface fractions of the interspaces 17 between the respective workpieces 3 are to be interpolated such that the individual workpieces 3 which are arranged on the workpiece spindle 1' are an integral part of an imaginary overall surface and this imaginary overall surface is covered by the tool 5 or by the tools 5' and 5". In this case, the tool 5, 5' or 5" is in engagement only when this imaginary surface to be covered intersects the workpieces 3.

To embed such interspaces or surface fractions 17 into an overall surface, algorithms known from the prior art may be used. In order, however, to interpolate the interspace 17 with the suitable travel parameters, it is necessary for a sufficiently long distance to be present between the individual workpieces 3. The feed of the tool 5, 5' and 5" to each workpiece 3 can thereby take place very quickly. A theoretical limitation of the number of workpieces 3 does not exist.

In order to achieve optimal results, and in terms of continuous transitions and a short processing time, the interspaces or the distances X between the workpieces 3 to be processed should not be greater than 30 mm, preferably no greater than 10 mm (see FIG. 2).

Figure 5:
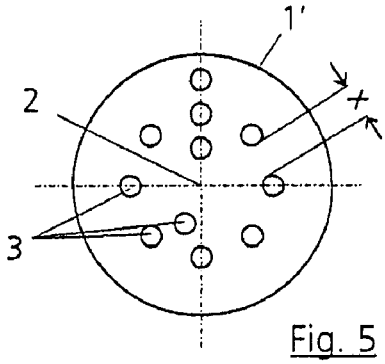
FIG. 5 shows a top view, corresponding to FIG. 4, with various arrangements of workpieces on the workpiece spindle.

FIG. 5 shows a top view of the workpiece spindle with a plurality of workpieces 3. As is evident, the workpieces may be arranged on the workpiece spindle 1' in any desired form, depending on the set requirements. Thus, for example, an arrangement in annular form is possible, and also, additionally or alternatively, a plurality of workpieces 3 which may be arranged one behind the other radially from the inside outward. Even an asymmetric arrangement is possible.

If required, the processing device can be used not only for the chip-removing processing of the workpieces 3, but also for grinding or polishing, and this may take place, where appropriate, in succession or else simultaneously during the chip-removing processing of other workpieces 3.

Instead of a vertical arrangement of the processing device, the latter may also be arranged horizontally, with the result that the axes 2, 8 and 18 are likewise arranged horizontally, instead of vertically.

The invention claimed is:

1. A method for processing surfaces of optical workpieces having non-rotationally symmetrical and/or aspherical surfaces, such as lenses or spectacle glasses, by means of at least one tool which is fed by means of a tool feed unit for the processing of the non-rotationally symmetrical and/or aspherical surfaces, at least one optical workpiece being held in a workpiece fixture rotating about an axis of rotation of a workpiece spindle, the at least one optical workpiece being received by the workpiece fixture in such a way that the axis of rotation of the workpiece spindle runs at a distance from a workpiece axis of the at least one optical workpiece, and from a longitudinal axis of the workpiece fixture, the longitudinal axis of the workpiece fixture lying at least approximately parallel to the axis of rotation of the workpiece spindle, and the axis of rotation being coupled to the feed movement of the at least one tool.

2. The method as claimed in claim 1, wherein the axis of rotation of the workpiece spindle runs outside the at least one optical workpiece.

3. The method as claimed in claim 1, wherein in a processing of a curved surface of the optical workpiece, the optical workpiece is oriented such that, in the case of a different surface curvature, the path curve segments to be covered by the at least one tool, which place lower demands on a movement travel arising from a larger radius of the curved surface, run tangentially with respect to a cutting direction of the at least one tool, and in that surface curve segments which place high demands on a movement travel arising from a smaller radius of the curved surface run radially in a direction of advance of the at least one tool.

4. The method as claimed in claim 1, wherein at least two optical workpieces are mounted in each case in a workpiece fixture.

5. The method as claimed in claim 4, wherein said optical workpieces are mounted at least approximately in one plane.

6. The method as claimed in claim 4, wherein said at least two optical workpieces are processed by one and the same tool.

7. The method as claimed in claim 1, wherein said at least one optical workpiece is processed by at least two different tools.

8. The method as claimed in claim 1, wherein said tool used is a lathe chisel.

9. The method as claimed in claim 8, wherein at least one tool is provided as a preliminary turning tool and at least one tool as a precision turning tool.

10. The method as claimed in claim 9, wherein a polycrystalline diamond tool is used for the preliminary turning tool and a monocrystalline diamond tool is used for the precision turning tool.

11. The method as claimed in claim 1, wherein a simultaneous processing of a plurality of optical workpieces at least two tools takes place.

12. The method as claimed in claim 1, wherein a plurality of optical workpieces are arranged symmetrically and/or asymmetrically to the axis of rotation of the workpiece spindle.

13. The method as claimed in claim 1, wherein a plurality of optical workpieces are arranged one behind the other radially with respect to the axis of rotation of the workpiece spindle.

14. The method as claimed in one of claim 1, wherein a plurality of optical workpieces in one or in a plurality of annular forms are arranged on the workpiece spindle.

15. The method as claimed in claim 1, wherein a feed of the at least one tool together with the tool cutting edge takes place via a pivoting movement.

16. The method as claimed in claim 15, wherein for the pivoting movement, a pivot axis of the at least one tool lies at least approximately perpendicular to the axis of rotation of the workpiece spindle.

17. The method as claimed in claim 1, wherein a feed of the at least one tool takes place at least approximately parallel to the axis of rotation of the workpiece spindle.

18. The method as claimed in claim 1, wherein the workpiece axes can be set at an angle to the axis of rotation of the workpiece spindle.

19. The method as claimed in claim 1, wherein a movement travel of the at least one tool is interpolated in interspaces with respect to the next optical workpiece to be processed, outside the optical workpiece, with travel parameters for a continuously smoothed path of the at least one tool.

20. The method as claimed in claim 19, wherein the movement travel between two adjacent workpieces is less than 30 mm, preferably less than 10 mm.

21. The method as claimed in claim 1, wherein a tool feed unit with a stroke frequency of >15 000 Hz, preferably of >20 000 Hz, with a stroke of up to 35 mm is used.

22. The method as claimed in claim 1, wherein a radial advancing movement of the at least one tool with respect to the optical workpiece takes place via the workpiece spindle.

23. The method as claimed in claim 1, wherein after chip-removing processing, the at least one workpiece is polished or ground in the same tool fixture.

24. A processing device for surfaces of optical workpieces having non-rotationally symmetrical and/or aspherical surfaces, such as optical lenses or spectacle glasses, with at least one tool which is fed by a tool feed unit for processing the non-rotationally symmetrical and/or aspherical surfaces, with at least one workpiece fixture rotating about an axis of rotation of a workpiece spindle and on which the optical workpiece is received with a workpiece axis, the axis of rotation of the workpiece spindle lying at a distance from the workpiece axis and from a longitudinal axis of the workpiece fixture, the longitudinal axis of the at least one workpiece fixture lying at least approximately parallel to the axis of rotation of the workpiece spindle, and the axis of rotation being coupled to the feed movement of the at least one tool.

25. The processing device as claimed in claim 24, wherein the axis of rotation of the workpiece spindle lies outside the at least one optical workpiece.

26. The processing device as claimed in claim 24, wherein the workpiece spindle is provided with at least two workpiece fixtures, the axes of the workpiece fixtures being arranged on the workpiece spindle such that the axis of rotation of the workpiece spindle runs in each case outside the optical workpieces.

27. The processing device as claimed in claim 24, wherein at least two different tools are provided.

28. The processing device as claimed in claim 27, wherein at least one of the tools is provided as a preliminary turning tool and at least one tool as a precision turning tool.

29. The processing device as claimed in claim 28, wherein the preliminary turning tool is designed as a polycrystalline diamond tool, and in that the precision turning tool is designed as a monocrystalline diamond tool.

30. The processing device as claimed in claim 24, wherein tools for processing different surfaces of optical workpieces on the workpiece spindle are provided.

31. The processing device as claimed in claim 24, wherein in a processing of a curved surface of the optical workpiece, the optical workpiece is oriented in the workpiece fixture such that, in the case of a different surface curvature, the path curve segments to be covered by the at least one tool, which place lower demands on a movement travel arising from a larger radius of the curved surface, run tangentially with respect to a cutting direction of the at least one tool, and in that surface curve segments which place high demands on a movement travel arising from a smaller radius of the curved surface run radially in a direction of advance of the at least one tool.

32. The processing device as claimed in claim 24, wherein a plurality of optical workpieces are arranged radially one behind the other on the workpiece spindle.

33. The processing device as claimed in claim 24, wherein a plurality of optical workpieces are arranged in annular form on the workpiece spindle.

34. The processing device as claimed in claim 24, wherein a plurality of workpieces are arranged on the workpiece spindle at least approximately in one plane.

35. The processing device as claimed in claim 24, wherein the workpiece axis can be set obliquely with respect to the axis of rotation of the workpiece spindle in the case of steep surface curvatures of the workpieces.

* * * * *

UNITED STATES PATENT AND TRADEMARK OFFICE

CERTIFICATE OF CORRECTION

PATENT NO. : 7,765,903 B2
APPLICATION NO. : 11/658426
DATED : August 3, 2010
INVENTOR(S) : Ralf Schorcht and Georg Michels It is certified that error appears in the above-identified patent and that said Letters Patent is hereby corrected as shown below:

Title Page, Item (73) Assignee – Replace "Carl Zeiss SMT AG" with --Carl Zeiss Vision GmbH--

Title Page, Item (30) Foreign Application Priority Data – Replace "10 004 037 454" with --10 2004 037 454--

Column 5, line 29 – Replace "line 20, 14." with --line 14.--

Column 5, line 41 – Replace "spindle 11, as" with --spindle 1', as--

Column 8, line 12 – Replace "in one of claim 1" with --in claim 1--

Signed and Sealed this
Eighth Day of November, 2011

David J. Kappos

David J. Kappos
*Director of the United States Patent and Trademark Office*